US005460372A

United States Patent [19]

Cook

[11] Patent Number: 5,460,372

[45] Date of Patent: Oct. 24, 1995

[54] GOLF CLUB GRIP

[75] Inventor: Raymon W. Cook, San Antonio, Tex.

[73] Assignee: Kliker Golf Company, Inc., San Antonio, Tex.

[21] Appl. No.: 241,154

[22] Filed: May 10, 1994

[51] Int. Cl.[6] ..... A63B 53/14

[52] U.S. Cl. ..... 273/81 R; 273/81 B

[58] Field of Search ..... 273/75, 73 J, 81 R, 273/165, 81.2, 81.4, 81.5, 81 B, 81 D, 80 R, 67 DA, 67 DB, 167 D; D21/214, 217, 218, 219, 220, 222

[56] References Cited

U.S. PATENT DOCUMENTS

| | | | |
|---|---|---|---|
| 2,482,120 | 9/1949 | Mishkinis | 273/81.4 |
| 2,781,196 | 2/1957 | Brandon | 273/81 B |
| 3,782,725 | 1/1974 | Gianbazi | 273/81 B |
| 4,629,191 | 12/1986 | Mancuso | 273/81 B |
| 4,936,582 | 6/1990 | Bernstein | 273/80 B |
| 5,133,555 | 7/1992 | Bailey | 273/81 B |
| 5,217,380 | 6/1993 | Martinet | 273/81 B |

FOREIGN PATENT DOCUMENTS

| | | | |
|---|---|---|---|
| 1201648 | 8/1970 | United Kingdom | 273/80 R |
| 1509479 | 5/1978 | United Kingdom | 273/81.4 |

*Primary Examiner*—Vincent Millin
*Assistant Examiner*—William M. Pierce
*Attorney, Agent, or Firm*—Gunn, Lee & Miller

[57] ABSTRACT

A grip for a golf club having a shaft. The grip has a generally tubular body portion for a length which extends along an upper section of the shaft. The body portion of the grip has a first end proximal to the shaft and a second capped end which is opposite the first end. The body portion has a wall thickness which is variable about the shaft along the bottom side, right side, and left side from the first to the second end. At the second end, the wall thickness along the top side is thin relative in relation to the wall thickness along the bottom side, while at the first end, the wall thickness along the top side is substantially equal to the wall thickness along the bottom side. The wall thickness of the grip along the top side is generally constant the entire length of the grip, and the thinness of the wall provides the golfer with an improved feel when a golf ball is struck. Several embodiments of the invention incorporate multifaceted planar faces which extend the entire length of the body portion of the grip to ensure the golfer grasps the grip the same way each time.

7 Claims, 4 Drawing Sheets

A
12
16
17
10
42
32
54
14
20
22
A 12
16
17
10
30
14
20

12
5
5
16
34
30
L1
10
47
44
48
54
45
46
28
4
4
20
22

312
316
TT4
360
L4
300
320
BT4
322

GOLF CLUB GRIP

BACKGROUND OF THE INVENTION

1. Field of the Invention

This invention pertains to golfing grips, and more particularly to golfing grips wherein a thin outer wall along the top side or right or left side of the grip in combination with positioning of the shaft within the body portion of the grip allows for maximum touch, feel, and control of the golf ball.

2. Background Information

It is well known that about 80% of a golfer's performance is based upon his attitude toward the game. More specifically, it is the golfer's level of confidence and his ability to properly execute the golf stroke. Although many grip designs are currently on the market, none specifically address the need for a grip which promotes the golfer's consistent execution of an effective golf stroke. If a golfer grips the club the same way each time, he will increase his effectiveness to properly execute the golf stroke, his confidence will subsequently rise, thus, improving the golfer's attitude toward the game. Unlike other grips, the present invention contributes to the consistent proper execution of the golf stroke needed to increase confidence improve attitude, and enhance performance.

When a golfer strikes a golf ball with a club face, a vibration is created which is often referred to as "feel". This vibration or feel travels up the shaft of the club to the grip area. This vibration may be sensed from the buttocks of the grip to the tip of the grip. To date, no known grip allows the vibration or feel traveling up the shaft to be felt the entire length of the grip. In contrast to existing grip designs, the present invention enables a golfer to hold the grip at the buttocks or choke down on the grip to any place he feels most comfortable and still feel or sense maximum vibration of the shaft.

The special and unique structure of the present grip brings the top side of the club shaft closer to the top side of the body portion of the grip. Therefore, the club shaft is located next to a very thin outer wall along the top side and flat top face of the body portion of the grip. The top side and flat top face located at the top of the grip is where all fingertips of both hands come in contact with and touch the grip. The thinner the grip and the closer the shaft is to the top of the grip where the fingers contact the grip, the greater the feel, touch, and control the golfer has over the ball. When striking a golf ball, the vibrations are transmitted from the club head through the shaft, to the fingers of both hands. The present invention addresses this consideration through placement of the shaft within the grip.

The present invention includes an embodiment which has an extraordinary feature of a twelve sided putter grip that is so unique and easy to use that it is a sure way of getting the golfer to grasp his putter grip the same way each time. This is important because doing the same thing, the same way, every time is a vital key to perfecting the best putting stroke.

The twelve sided grip of the present invention has twelve flat, planar faces with each face creating a special angle to the total circumference of the grip. Each of the twelve sides create a flat planar face which enables the grip to fit every conceivable contour of the hand as the fingers of the left hand force the grip into and snugly up against the buttocks of the left hand. Each planar face automatically forces the grip into the proper position in the left hand the same way every time the club is grasped. It is estimated that this repeatability of gripping alone should improve the golfer's confidence in his grip and in his putting by 50% (improving his putting by an estimated four strokes).

Prior art putter grips do not directly address the problem of the golfer gripping the putter the same way each time he grasps the club. It is imperative that a grip be designed to help improve a golfer's putting stroke. Since putting is considered by many golf experts to be responsible for over 50% of a golfer's total golfing game performance, if a golfer has confidence in his putting ability, in most cases, the golfer has confidence in the rest of his game. The present invention is intended to help every golfer enjoy the game of golf more by increasing the golfer's confidence in his ability to properly execute the golf stroke.

The putter grip of the present invention has overall increased versatility. The grip is constructed, such that the size of the grip may be reduced from the bottom side to accommodate the golfer with smaller hands. Size reduction still maintains the twelve facets without distorting the overall maximum touch and feel of the grip. The standard golf club shaft has a 0.600 inch butt outer diameter, but the grip of the present invention may be modified to fit any size golf shaft. The grip is constructed so that the contour on the bottom of the grip-can be changed to a lesser contour or to a straight bottom and still maintain the twelve planar, faceted faces but at a slightly different angle and width. The specific angles formed at the butt of the grip extend all the way to the tip of the grip, regardless of the size of the grip.

The present invention also includes an alternative embodiment grip which is a modification of the twelve sided grip discussed above. This alternative embodiment also maintains the shaft position in relation to a very thin outer wall of the body portion of the grip at the top providing a similar touch and feel, but utilizes ten planar faces. All the planar faces and angles extend from the top of the buttocks of the grip to the tip of the grip. This second embodiment includes a single elongated planar face on the left side of the body portion of the grip which aides the golfer in keeping the club face square to the desired line the golfer wants the ball to roll. The singular elongated face on the left side fits firmly and securely against the palm of the left hand. This flatness on the left side gives a positive alignment indicator of the club face orientation each time the club is grasped, thus helping to control the accuracy of the putting stroke.

While these two embodiments of the present grip include flat faces which limit their use to putter grip designs, the present invention may include a round grip embodiment which may be used on all golf clubs. The round grip is constructed so that when the grip is positioned around the shaft with the shaft to the right side of the very thin outer wall of the grip, the fingertips of the left hand are closer to the vibrating shaft than in existing shaft grip designs. When striking a golf ball, the vibrations are transmitted from the club head through the shaft to the fingertips of the left hand. This provides the golfer with maximum touch, feel, and control over the ball.

SUMMARY OF THE INVENTION

The present invention is a grip for a tubular shaft of a golf club which gives the golfer increased touch, feel, and control over the ball through the improved sensing of the vibrations created when the club strikes the golf ball. These vibrations travel from the golf club head, along the shaft and through to the entire length of the shaft grip to the golfer's fingertips. The present grip is on the tubular shaft of a golf club, the shaft being concentric about a first longitudinal axis. The grip of the present invention has a generally tubular body portion which extends along an upper section of the shaft. The body portion of the grip has a first end with an opening to receive the club shaft and a second capped or closed end which is opposite the first end. The body portion has a generally cylindrical shape. The body portion further has a wall thickness which is variable about the shaft axis from the first to second end of the grip along the bottom side, right side, and left side of the grip. At the second end or the butt end of the grip, the wall thickness along the top side of the grip is less as compared to the wall thickness along the bottom side. However, the wall thickness along the top side from the butt end to the tip end of the grip is a constant thickness. This unique construction allows for maximum touch or feel, and thus improved control of the golf ball during putting.

It is an object of applicant's invention to provide a golfing grip which, by incorporating a thin outer wall along the top of the grip, gives the golfer more touch, feel, and control over the ball through improved sensing of the vibrations created from striking the golf ball, the vibrations traveling from the club head along the shaft through the grip to the golfer's fingertips. As the grip gets narrower at the bottom portion below the left hand, the complete circumference of the grip gives greater feel to the right hand.

It is also an object of applicant's invention to provide a golfing grip which permits vibration or feel to travel along the entire length of the grip.

Another object of applicant's invention is to provide a golfing grip which permits the golfer to hold the grip at the buttocks of the grip or choke down on the grip to any place he desires and still sense maximum vibration.

Another object of applicant's invention is to provide a golfing grip design which aids the golfer in grasping his putter grip the same way each time the club is used.

Another object of applicant's invention is to provide a golfing grip design with flat, planar faces such that the grip fits the various contours of the hand as the fingers of the hand force the grip into and snugly up against the buttocks of the hand, such that each flat, planar face automatically forces the grip into the proper position into the hand, the same way every time.

It is also an object of applicant's invention to provide an alternate grip which can be cast, machined, or molded in a one part construction as a one piece grip and shaft.

Another object of applicant's invention is to provide a golfing grip which, by incorporating a 10 sided grip, permits a singular flat, planar face on the left side of the grip to aid the golfer in keeping the club face square to the desired line the golfer wants the ball to roll.

Another object of applicant's invention is to provide a golfing grip which, by incorporating a round grip wherein the body portion of the grip is positioned around the shaft to the right side of the very thin outer wall of the grip, brings the fingertips of the left hand in closer contact with the shaft such that vibrations are transmitted through the shaft to the fingertips of the left hand.

Other purposes and advantages will become apparent from the following description in light of the attached drawings.

DETAILED DESCRIPTION OF THE PREFERRED EMBODIMENT

Figures 1, 2, 3, 3A:
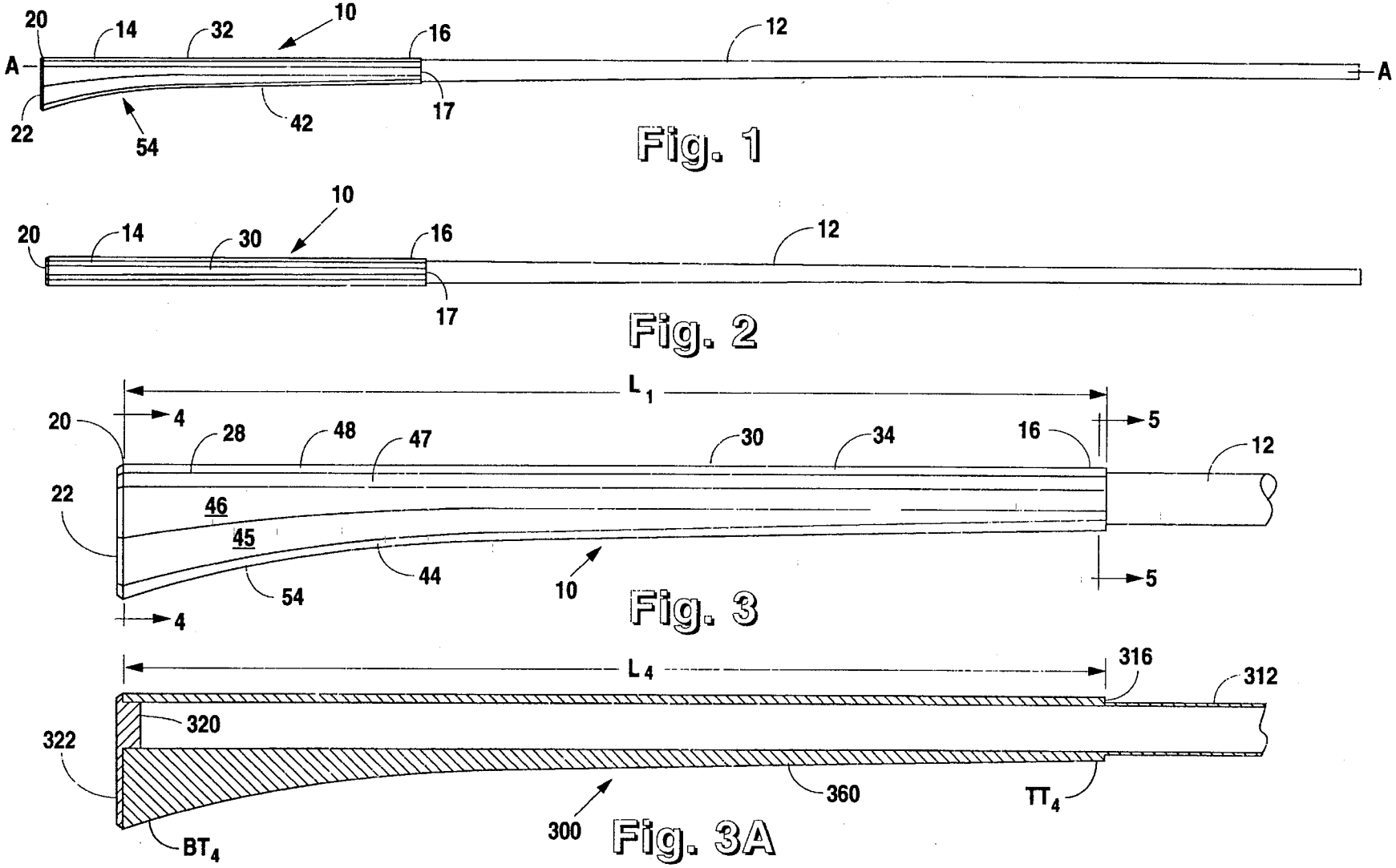
FIG. 1 is a side view of the twelve sided grip of the present invention shown with the shaft.
FIG. 2 is a top view of the twelve sided grip of the present invention shown with the shaft.
FIG. 3 is a side view of the twelve sided grip of the present invention.
FIG. 3A is a cross-sectional view of a unitary grip/shaft combination of the present invention.

Referring to FIG. 1, a tubular, rigid golf club shaft (12) concentric about its longitudinal axis A, is surrounded along its' upper section by the golf club grip (10) of the present invention. The grip (10) has a generally tubular body portion (14). The body portion (14) has a first end (16), commonly referred to as the tip, having an opening (17) for receiving the shaft (12) and a second capped or closed end (20), commonly referred to as the buttocks, opposite the first end (16). A tapering shaft (12) extends from the first end (16) of the grip and in FIG. 1, is shown as being separately constructed from the body portion (14) of the grip (10). The buttocks of the present invention are located at the second end (20) of the grip (10) and is the end of the grip where the largest diameter portion of the club shaft (12) rests inside the buttocks (28) and against the buttocks cap (22) of the grip (10). Although the outer surface of most grip buttocks are round or smooth oval shaped with perhaps one somewhat flat top face, the present invention of FIGS. 1–5 is shown as having a plurality of planar faceted flat faces which form a faceted oval shaped outer surface. FIG. 1 illustrates a side view of a grip referred to as the Twelve Touch Grip wherein the body portion (14) of the grip (10) has twelve planar faceted faces as discussed below.

The Twelve Touch Grip embodiment and the Ten Touch Grip embodiment (discussed in conjunction with FIGS. 6–9 below) contain flat, planar faceted faces which, according to current golfing regulations, may only be used on putters. Therefore, FIGS. 1–9 illustrate a grip design which is generally limited in use with putters.

The buttocks cap on most putters is generally round, oval or elongated and, in rare cases, may be slightly flat at the top of the putter grip. The buttocks cap (22) of the present invention is located at the second end of the body portion (14) of the grip (10) and forms a cap for the buttocks (28) of the grip (10).

Opposite the buttocks cap (22) is the grip opening (17)

which is in the first end or tip end (16) of the body portion (14) of the grip (10). All known prior art tip ends have generally smooth rounded outer surfaces as they taper out from the bottom side of the grip into the shaft. On existing "flat" top putter grips, this smooth rounded outer surface of the grip tip extends approximately the last 1½ " of the grip to the tip end. Contrary to this general or typical design, all twelve planar-faceted faces in the present invention, including the flat top face, extend all the way from the buttock end to the tip end of the grip. The tip of the present invention does not have the smooth rounded outer surface as it tapers from the bottom side of the grip to the shaft, but instead, continues to maintain the unique construction consisting of twelve planar faceted faces. Where a traditional design look is desired, the tip end (16) of the grip (10) may be modified where the 12 planar faceted faces extending from the buttocks end (20) downward toward the tip end (16), terminate within 1" to ¼ " of the tip end (16) to provide a smooth rounded outer surface or any other contrasting outer surface of the grip tip end.

The flat top planar surface (30) is the planar face which is located along the top side (32) of the body portion (14) of the grip (10) and is the surface of the grip (10) that is used as a guide for placing the thumbs on the grip or for the thumbs to rest upon as the golfer grasps the grip. This flat top planar surface (30) faces away from the golfer when the body portion (14) of the grip (10) is grasped by the golfer. With the preferred Twelve Touch Grip embodiment (10), the flat top surface (30) extends all the way from the buttocks (28) to the tip end (16) of the body portion (14) of the grip (10).

Underneath and opposite the flat top side (32) is the bottom side (42) of the body portion (14). The bottom side (42) of the grip is by definition underneath and opposite to the flat top side (32). The bottom side (42) of the Twelve Touch Grip (shown in FIG. 1–5) and the Ten Touch Grip (shown in FIGS. 6–9) is made up of the multifaceted surfaces which face toward the golfer when the body portion (14) of the grip (10) is grasped by the golfer during putting.

Referring now to FIG. 2, a top view of the present invention (10) is illustrated and shows the golfing grip with the shaft (12) which extends from the tip or first end (16) of the body portion (14) of the grip (10). The flat top planar surface (30) extends along the entire length of the body portion (14) of the grip (10). The Twelve Touch Grip embodiment (10) has a center flat top planar surface (30) on the body portion (14) of the grip (10) which is 0.250 inches wide and extends all the way from the buttocks end (20) to the tip end (16) of the grip (10). This flat top planar surface (30) remains the same width, i.e., 0.250 inches from the buttocks end (20) and at the tip end (16). The reason for this constant width is that from the top side (32) of the buttocks (28) to the top side of tip end (16) of the grip is a completely straight line. Although the width of this flat top planar surface (30) does not vary as it extends along the entire length of the body portion (14) of the grip (10), all of the other planar faceted faces of the embodiment (10) vary slightly in width from the buttocks end (20) of the body portion (14) of the grip to the tip end (16) of the body portion (14) of the grip (10).

FIG. 3 is a right side view of the Twelve Touch Grip embodiment (10) . This enlarged view of the body portion (14) of the right side (50) of the grip (10) provides a clear illustration of the multifaceted side surfaces as well as the buttocks cap (22).

The right side (50) and left side (52) of grip (10) are each made up of five distinct flat planar faces (44, 45, 46, 47, 48) and (34, 35, 36, 37, 38) respectively). The bottommost planar face (40), which is opposite the flat top planar surface (30), is at a greater distance from the flat top planar surface (30) at the buttocks end (28) of the body portion (14) of the grip (10) than at the tip end (16). The body portion (14) tapers down as it approaches the tip end (16) of the grip such that there is a less distance between the bottommost planar face (40) and the flat top planar surface (30) at the tip end (16) of the grip (10) than at the buttocks end (28). An arcuate portion (54) of the bottom side of the grip (10) forms a saddle type grip.

Although, the wall thickness of the body portion (14) along the right side (50), left side (52), and bottom side 42) of the body portion (14) varies from the buttock end (20) to tip end, the wall thickness along the top side (32) of the body portion (14) remains generally constant the entire length ($L_1$) of the grip (10). The widths of the planar faceted faces, with the exception of the flat top planar surface (30) which remains at a-constant width, taper as they approach the tip or first end (16) of the grip (10) such that, at the tip (16) of the grip, the wall thickness along the top side (30) of the body portion (14) is equal to the wall thickness along the bottom side (42) of the body portion (14) as may be clearly seen in FIG. 5.

Figure 4:
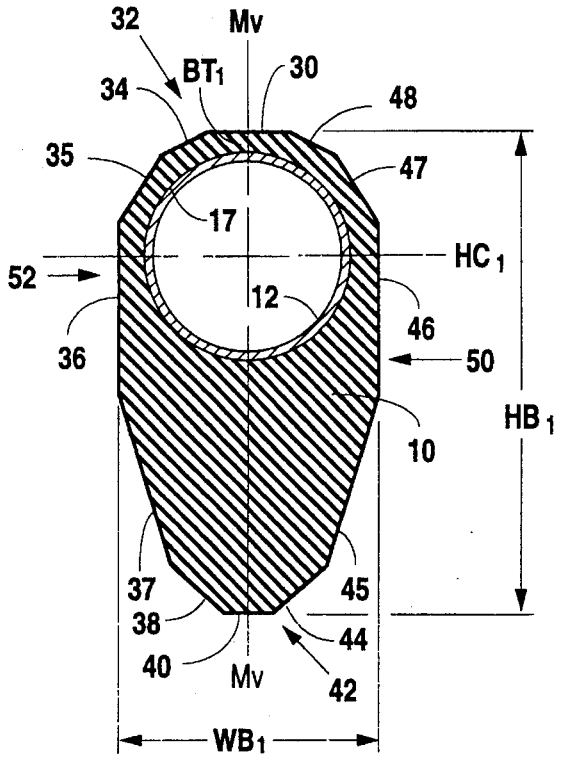
FIG. 4 is a cross-sectional view of the buttocks end of the twelve sided grip of the present invention.

FIG. 4 is a cross-sectional view taken along line 4—4 of FIG. 2 and shows the twelve distinctive planar faceted faces of the body portion (14) of putter grip (10). These twelve planar faces form twelve distinctive angular intersections. The intersections and planar faces are bilaterally symmetrical about a vertical median plane ($M_v$) of the body portion of the grip. For the preferred embodiment, the width ($WB_1$) of the body portion of the grip at the buttocks or second end (20) should be 0.750 inches tapering to a width ($WT_1$) of 0.724 inches at the tip end (16) of the grip, while the buttocks end height ($HB_1$) of grip 10 is approximately 1.375" and the tip end height ($HT_1$) is approximately 0.750" (see FIGS. 4 and 5).

Referring once again to FIG. 4, the flat top planar face (30) and the bottommost planar face (40) are shown in their opposite and generally parallel configuration. For maximum performance, the flat top planar face (30) is 0.250 inches wide and the bottommost flat planar face (40) is 0.125 inches wide. The bilaterally symmetrical design is particularly evident in FIGS. 4 and 5. All of the faces left of the vertical median plane ($M_v$) of the body portion (14) are identical in length, angle, depth, and width to corresponding faces to the right of the vertical median plane ($M_v$).

FIG. 4 shows the shaft (12) as it is located inside of the buttocks of the body portion of the grip. Seven of the twelve planar faceted faces (30, 34, 35, 36, 46, 47, and 48) as well as seven of the twelve angular intersections fall directly outside of the shaft along the left side (52), right side (50), and top side (32) of the body portion (14). The body portion (14) of the grip (10) is a solid material composition and contacts outer surface of the shaft. This provides adequate wall thickness of the body portion for easy manufacturing and application of the body portion of the grip on the shaft without losing the maximum feel and touch of the shaft through the body portion of the grip. Although the thickness of the wall is variable about the shaft except beneath face (30), the preferred embodiment incorporates a wall thickness ($BT_1$) along the top side (32) of the body portion (14) of the grip of approximately 0.070 inches. Specifically, the wall thickness ($BT_1$) between top face (30) and the outer surface of shaft (12) measured at the vertical centerline of shaft (13) is approximately 0.062 inches and gradually increases to a wall thickness of 0.078 inches between side faces (36) and (46) and the outer surface of shaft (12) measured at the horizontal centerline ($HC_1$) of shaft (12).

The width dimensions of the twelve planar faceted faces contribute to the ultimate touch and feel for the golfer using the grip. The flat top planar face (30) along the top side (32) of the body portion (14) is 0.250 inches wide while the bottommost planar face (40) of the body portion (14), which is opposite to the flat top planar face, is 0.125 inches wide. Upper right planar face (48), adjacent and clockwise to the flat top planar face (30) is sloped at an angle to keep the wall thickness ($BT_1$) body portion of the grip (10) as thin and as close to the shaft (12) as possible. Planar face (48) is approximately 0.143" wide at the buttocks end (20). Continuing clockwise from the flat top planar surface (30), the next planar face (47) is approximately 0.293" wide and sloped at an angle to maintain as close a distance as possible to the shaft. Continuing to travel clockwise around the grip, the next planar face (46) is 0.500 inches wide at the buttocks end (20). The upper 0.218 inches of planar face (46) continues to have a thin wall thickness ($BT_1$) of approximately 0.078". The maximum wall thickness ($BT_1$) between side faces (36) and (46) and the outer surface of shaft (12) measured at the horizontal centerline ($HC_1$) of shaft (12) is 0.093 inches. Thereby, maximum feel for the golfer is achieved.

The width of the next planar face (45) is 0.424" and the next face (44) is 0.220". As previously discussed, the body portion (14) is bilaterally symmetrical. Therefore, corresponding faces on the left side (52) of the body portion (14) are the same width as those on the right side (50).

As illustrated in FIG. 4, the wall thickness ($BT_1$) along the top side (32) of the body portion (14) of the grip (10) including faces (30, 34, 35, 47, and 48) ranges from 0.062 inches to 0.078 inches. It is along the top side (32) of the body portion (14) where over 90% of the total feel is transmitted to the golfers' hands and fingertips when the putter face strikes the golf ball. Slight variations in wall thickness at this same area may occur based on the type of material used to produce the body portion or based on the size of the body portion. The body portion (14) of a preferred grip may be made from plastic, rubber, cork, cored fabric or any other suitable lightweight, pliable material or combination thereof. Such material may be molded, cast, or produced by other known manufacturing methods. The angular intersections and flat, planar faces on the body portion may be identified or made more visible by means of various perforations, marks, lines, grooves, indentations, or marked with a variation of colors.

A grip may also be made from a high strength plastic polymeric composition known by the trade name LEXAN (No. 141) produced by General Electric. This material may be cast, machined, or molded. LEXAN (No. 141) may be used to form the body portion of the grip and adopted to receive a club shaft (12). Further, LEXAN (No. 141) may also be used for construction of a separate golf club or portions thereof or a club where grip-(10) and shaft (12) are cast, molded, or machined as one unitary piece. A unitary construction of the grip and shaft is not known in the prior art.

FIG. 3A illustrates such a unitary construction. Where the shaft (312) and the grip (310) are one, unitary piece, the impact vibrations are directly conducted up the shaft and grip to the golfer's hands.

FIG. 3A is a cross-sectional view of a unitary grip/shaft combination (300) incorporating the present invention. Shaft (312) is not a separate piece as shown in the other embodiments. The inside diameter of the shaft becomes the inside diameter of the grip bore (360). The grip bore (360) extends the full length ($L_4$) of the grip (300) and results in a thin top side wall thickness ($BT_4$) at the buttocks end (320). The thin top side wall maintains a generally constant thickness of approximately 0.081" from the buttock end (320) to the tip end (316). The grip (300) is provided with a buttock cap (322) as shown. In all other respects, the unitary embodiment (300) is similar to embodiment (10) discussed above or the other embodiments discussed below, particularly with regard to the multifaceted faces and angular intersections.

Alternatively, the body portion (14) of the grip (10) may be made from aluminum to be used in conjunction with an aluminum, steel, graphite or any other shaft material composition presently available. An aluminum grip (10) may be extruded, drawn, cast, machined or molded in a one part unitary construction with the shaft.

As mentioned above, FIG. 4 shows the shaft (12) inside of the generally tubular body portion (14) of the grip (10). The body portion has seven flat, planar faces coming within 0.078" of the shaft (12). Due to the design of the grip (10), the wall thickness ($BT_1$) along the top side (32) of the body portion (14) is thinner than along any other side except at the tip. Thus, the shaft (12) is positioned in the top half of the body portion of the grip where there is a minimum wall thickness of the body portion from the tip end (16) of the grip to the buttocks end (20) of the grip. The seven very thin faceted faces on the top half of the buttocks, stay in very close contact with the shaft (12) all the way to the tip end. When grasping the grip (10), all ten of the golfer's fingertips are touching along the full length of the top half of the grip (which is in the closest proximity of the top half of the shaft). The thin outer wall thickness along the top side of the grip, created by these seven faceted faces, permits the vibrations that are created when striking a golf ball to travel along the entire length of the grip. This is what gives the maximum feel and control over the ball. Therefore, when the golfer strikes the golf ball, the vibration travels along the shaft to the fingertips of the left hand and the fingertips of the right hand via all top flat planar faces of the grip (10), thereby yielding increased feel or touch for the golfer.

Figure 5:
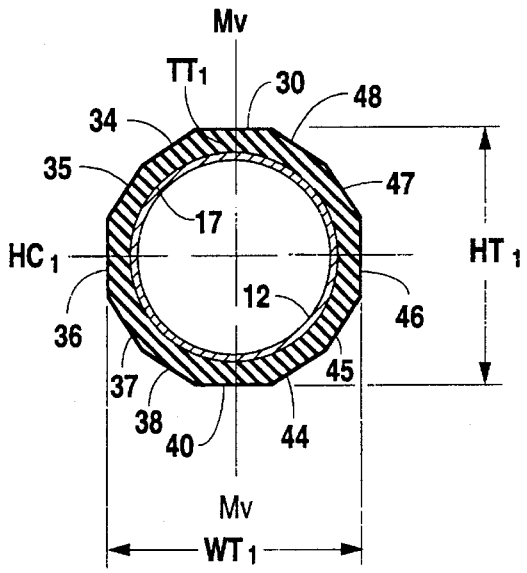
FIG. 5 is a cross-sectional view of the tip end of the twelve sided grip of the present invention.

Referring now to FIG. 5 which is a cross-sectional view taken along line 5—5 of FIG. 2, the shaft (12) is shown inside of the body portion (14) of the grip (10) at the tip end (16) of the body portion of the grip. The twelve planar faceted faces of the body portion taper from the buttocks end (20) along the body portion (14) to the tip end (16) of the body portion. At the tip end (16) of the body portion, the shaft (12) is centrally located within the body portion. The wall thickness ($TT_1$) at the tip end (16) is approximately 0.062 at each planar face. The approximate width of the planar faces of the grip (10) are as indicated in Table 1. It should be understood that slight variation of these dimensions may be allowed and still achieve the intents and purposes of the present invention.

TABLE 1

| FACE | WIDTH AT BUTTOCKS END (20) | WIDTH AT TIP END (16) |
|---|---|---|
| 1. Face 30 | .250" | .250" |
| 2. Face 34 | .143" | .178" |
| 3. Face 35 | .293" | .178" |
| 4. Face 36 | .500" | .224" |
| 5. Face 37 | .424" | .178" |
| 6. Face 38 | .220" | .178" |
| 7. Face 40 | .125" | .224" |

TABLE 1-continued

| FACE | WIDTH AT BUTTOCKS END (20) | WIDTH AT TIP END (16) |
|---|---|---|
| 8. Face 44 | .220" | .178" |
| 9. Face 45 | . 424" | .178" |
| 10. Face 46 | .500" | .224" |
| 11. Face 47 | .293" | .178" |
| 12. Face 48 | .143" | .178" |

The planar faceted faces of the Twelve Touch Grip are continuous from the buttock end (20) to the top end (16) of the body portion (14). The planar faces do not lose their distinctiveness by tapering into a rounded tip end as is found with existing grip constructions.

An alternative embodiment of the present inventive grip is shown in FIGS. 6–9. The alternative embodiment (100) is referred to as the Ten Touch Grip.

Figure 6:
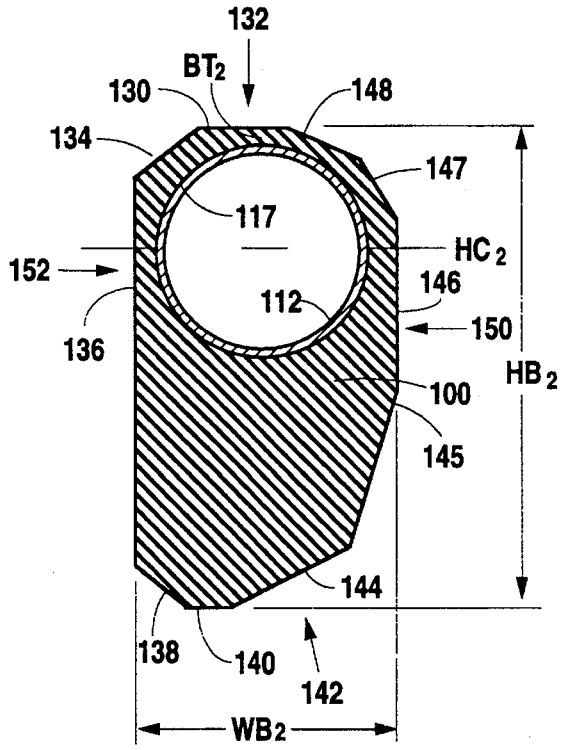
FIG. 6 is a cross-sectional view of the buttocks end of the ten sided grip of the present invention.
Figure 7:
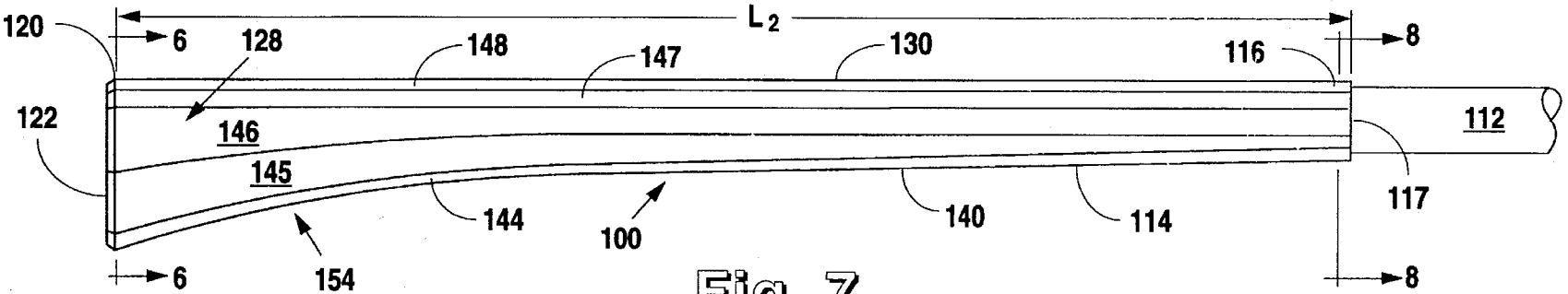
FIG. 7 is a right side view of the ten sided grip of the present invention.

FIG. 6 illustrates cross-sectional view taken along line 6—6 of FIG. 7 of the buttocks end (120) of the alternative grip (100) construction having a body portion (140) with ten planar faceted faces. Because the grip (100) incorporates ten planar faceted faces the Ten Touch Grip may be used only as a grip for a putter.

Figure 7A:
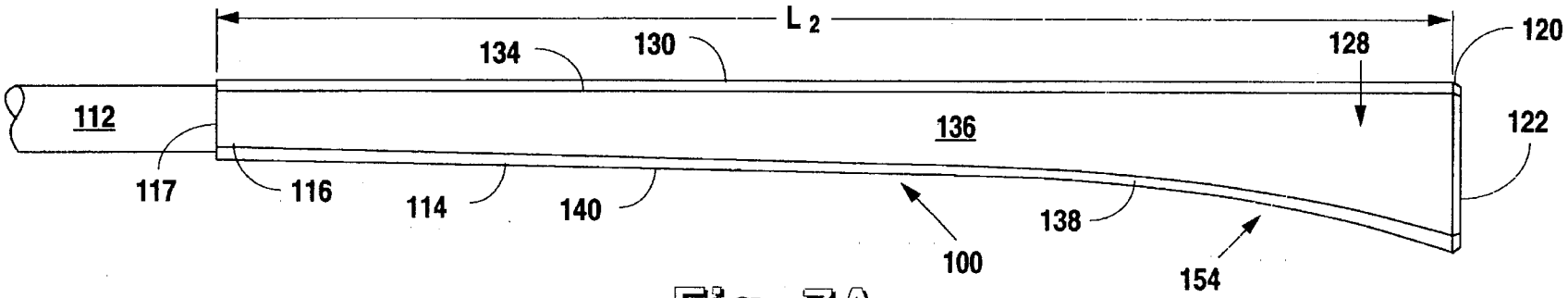
FIG. 7A is a left side view of the ten sided grip of the present invention.

Basically, the Ten Touch Grip (100) is a modification to the Twelve Touch Grip discussed above. The Ten Touch Grip (100) as shown in FIG. 7A has a single elongated planar face (136) that, in the preferred embodiment, is approximately 1.093" wide and extends along the entire left side (152) of the body portion (114) of the grip (100) from the buttocks end (120) to the tip end (116). This single elongated planar face (130) varies in width as it extends along the body portion (114) of the grip (100) from the buttocks end (120) to the tip end (116). The width of the face (136) is approximately 1.093" at the buttocks end (120) and is approximately 0.437" at the tip end (116) (See FIG. 8). The buttocks end width ($WB_2$) of grip 100 is approximately 0.750" and the buttocks end height ($HB_2$) is approximately 1.375".

As with the Twelve Touch Grip (10), in the Ten Touch Grip (100) the shaft (112) position and wall thickness ($BT_2$) at the top side of the body portion provides a similar touch and feel. The ten, distinct faces extend the entire length ($L_2$) of the grip (100) and do not taper or merge into a smooth, round tip end as with existing grips. The wall thickness along the top side (132) of the Ten Touch Grip (100) is thin relative to the wall thickness along the bottom side (142). While the wall thickness along the right side (150), left side (152), and bottom side (142) varies along the length ($L_2$) of the grip (100), the wall thickness along the top side (132) remains generally constant.

The wall thickness ($BT_2$) of the grip at the top flat face (130), measured perpendicularly from the top surface of face (130) to the outer surface of shaft (112), is approximately 0.059". The wall thickness of the grip gradually increases under faces (148) and (147) until it reaches a maximum thickness of 0.093" at face (146), measured along horizontal centerline ($HC_2$) from the outer surface of shaft (112) to the top surface of the face (146). Moving counterclockwise around the grip (112) from the top face (130), the wall thickness of the grip (112) increases to a maximum of 0.093" beneath the left side face (134) and then decreases down to a thickness of 0.062" beneath elongated left side face (136); again measured along horizontal centerline ($HC_2$) from the outer surface of shaft (112) to the top surface of elongated left side face (136).

The tip end width ($WT_2$) of grip 100 is approximately 0.724", while the tip end height ($HT_2$) of grip 100 is approximately 0.724".

The width of flat, planar face (130) remains constant the entire length ($L_2$) of the body portion (114). Further, the wall thickness beneath face (130) remains the same from the buttocks end to the top end.

The approximate widths of the planar faces of the grip (100) of the ten touch embodiment are as indicated in Table 2. Again, it should be understood that slight variations of these dimensions may be allowed without departing from intent and purposes of the present invention:

TABLE 2

| FACE | WIDTH AT BUTTOCKS END (120) | WIDTH AT TIP END (116) |
|---|---|---|
| 1. Face 130 | .250" | .250" |
| 2. Face 134 | .234" | .218" |
| 3. Face 136 | 1.093" | .437" |
| 4. Face 138 | .171" | .218" |
| 5. Face 140 | .140" | .265" |
| 6. Face 144 | .375" | .171" |
| 7. Face 145 | .468" | .203" |
| 8. Face 146 | .500" | .234" |
| 9. Face 147 | . 191" | .203" |
| 10. Face 148 | .225" | .171" |

The single elongated planar face (136) on the left side (152) of the body portion (114) of the grip (100) aids the golfer in keeping the club face (not shown) square to the desired line the golfer wants the ball to roll. This single elongated planar face (136) fits firmly and securely against the palm of the left hand and with this type of flatness on the left side, gives a positive alignment of the club face each time the club is grasped which helps control the accuracy of the putting stroke.

FIG. 7 is a right side view of the Ten Touch Grip (100). As with the Twelve Touch Grip (10), all of the flat planar faces and angular intersections extend the full length $L_2$ from the buttocks to the tip of the grip. A chamfered or bevelled edge buttocks cap (122) forms a cap for the second end (120) of the grip (100). The flat top planar surface (130) which is used as a guide for placing the thumbs on the grip or for the thumbs to rest upon as the golfer clutches the grip, extends the entire length of the body portion (114) to the tip or first end of the grip as discussed above. The bottommost planar face (140) of the body portion is underneath and opposite to the flat top planar surface (130).

Figure 8:
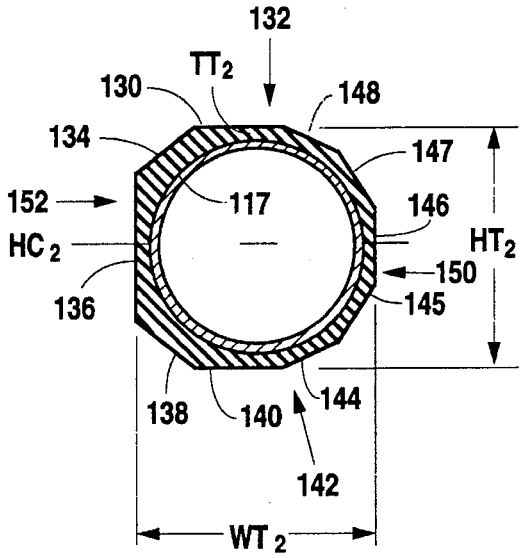
FIG. 8 is a cross-sectional view of the tip end of the ten sided grip of the present invention.

FIG. 8 is an cross-sectional view taken along line 8—8 of FIG. 7. The shaft is shown in FIG. 8 as positioned within the body portion of the grip. The body portion (114) of the grip (100), however, is not bilaterally symmetrical about the shaft (112) as it was with the Twelve Touch Grip (10). As may be seen in FIGS. 7 and 8, the flat, planar faces have tapered from the buttocks end (120) to the tip end (116) of the grip. The elongated planar face (136) on the left side (152) of the body portion (114) of the grip (100), however, still covers a majority of the surface area along the left side (152) of the grip (100).

Figure 9:
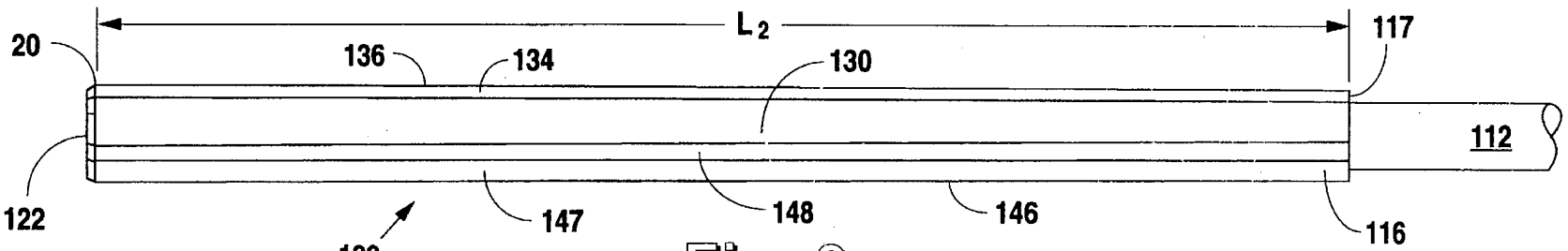
FIG. 9 is a top view of the ten sided grip of the present invention.

Referring now to FIG. 9, the Ten Touch Grip (100) is shown in top view. The flat top planar surface (130) is clearly identifiable as it extends from the buttocks (120) to the tip (116) of the grip (100). The flat top planar surface (130) retains a constant width along the entire length ($L_2$) of the body portion (114) of the grip (100). As discussed above, the grip (100) may be made of various materials and a unitary construction.

While grip embodiments (10) and (100) are structured specifically for golf putters, the inventive concept of positioning the golf grip to the club shaft, such that the wall thickness along the top side of the body portion of the grip is thin in relation to the wall thickness along the bottom side of the body portion of the grip may be extended to a round grip and may thus be used for all golf clubs to include irons, woods, and putters.

Figure 10:
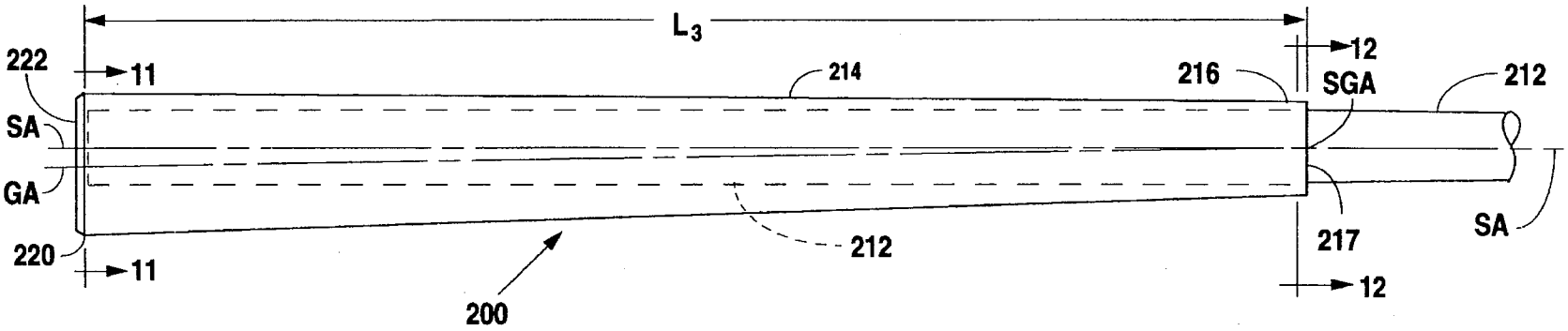
FIG. 10 is a side plan view of a round grip of the present invention.
Figure 12:
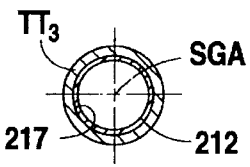
FIG. 12 is a cross-sectional view of the tip end of a round grip of the present invention.
Figure 11:
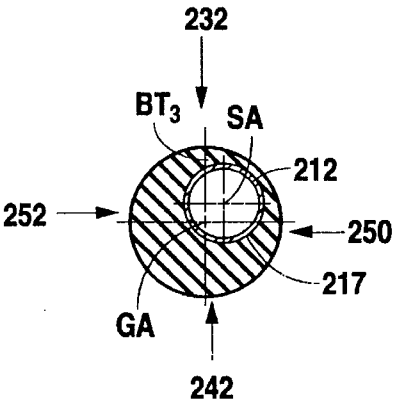
FIG. 11 is a cross-sectional view of the buttocks end of a round grip of the present invention.

A third embodiment of the present invention is illustrated in FIGS. 10–12. This third embodiment (200) is referred to as the Round Grip.

FIG. 10 is a side plan view of the Round Grip embodiment. The shaft (212) is shown as it is positioned within the body portion of the Round Grip (200). The rounded buttocks cap (222) forms a cap for the buttocks end (220) of the grip (200). The buttocks as well as the grip end (219) of the shaft (212) contact the inside of the buttocks cap (222).

Travelling from the buttocks or second end (220) to the tip or first end (216) of the grip (200), the size of the body portion (214) tapers and the orientation of the shaft (212) shifts such that when the tip (216) of the grip is reached, the longitudinal axis of the shaft (SA) coincides (at SGA) with the longitudinal axis (GA) of the grip (200) (see FIGS. 10 and 12). As noted with the other embodiments of the present invention, grip (200) may be made of various materials and a unitary construction, so long as the thin wall thickness is maintained along the top right side of the entire length of the grip.

FIG. 11 illustrates a cross-sectional buttocks end view of the Round Grip (200) construction. The shaft (212) is positioned inside of the body portion (214) of the grip (200). The grip (200) is eccentric about the longitudinal axis (SA) of the shaft (212). At the buttock end (220) of the grip (200), the longitudinal axis (SA) of the shaft (212) is offset from the longitudinal axis (GA) of the body portion (214) of the grip (200). The axis (SA) of the shaft (212) is to the upper right hand side of the axis (GA) of the body portion (214) of the grip (200). The shaft axis (SA) is 0.138" above and 0.138" to the right of the grip axis (GA) at the buttocks end (220) of the grip (200). The shaft axis (SA) and the grip axis (GA) gradually converge until they intersect at a shaft/grip axis (SGA) at tip end (216) of the grip (200). The wall thickness ($BT_3$) along the top side (232) of the body portion (214) is thin, however, relative to the wall thickness ($BT_3$) along the bottom side (242) of the body portion (214) like the Twelve Touch (10) and Ten Touch Grip (100) embodiments.

Whereas FIG. 11 illustrates the thin side of the body portion of the grip positioned to the right side of the shaft, the thin side of the body portion of the grip could be placed to the left side or to the top side of the shaft. No existing drivers, irons, or woods utilize an eccentric grip to shaft centerline relationship. Any modifications to the interior or exterior structure of the golf grip must be and can be adjusted to meet USGA rules and still remain within the spirit of the present invention.

The grip (200) is constructed such that when the body portion (214) of the grip (200) is positioned around the shaft (212) with the shaft (212) to the upper right side (249) of the grip axis (GA), the thin outer wall ($BT_3$) along the top right side of the body portion brings the fingertips of the left hand in closer contact with the shaft (212). Due to the upper right side positioning of the shaft (212), the bottom side (242) and particularly the bottom left side (251) of the body portion (214) forms a thick outer wall for the bottom of the shaft. When striking the golf ball, the vibrations are transmitted from the club head, via the shaft through the grip to the fingertips of the left hand. This provides the golfer with the maximum touch, feel, and control over the ball.

The outside diameter of grip (200) at the buttocks end (220) is 1.125" while the outside diameter of the grip at the tip end (216) is 0.724". The wall thickness ($BT_3$) along the top right side of the grip is approximately 0.062" at buttocks end (220). The wall thickness ($TT_3$) at the tip end (216) is 0.062" around the entire outer circumference of the shaft (212). Thus, the wall thickness of the grip 200 along the top right side of the grip from the buttocks end (220) to the tip end (216) is generally constant at a thickness of approximately 0.062". This results in an eccentric shaft to grip centerline relationship not known in the prior art.

The Twelve Touch Grip, 10 Touch Grip, and Round Grip all share a thin outer wall along the top side of the body portion of the grip relative to the wall thickness along the bottom side of the body portion of the grip. This gives the golfer more touch, feel, and control over the ball through the vibrations created when the club strikes the golf ball and these vibrations travel from the club head, through the shaft to the golfer's fingertips.

While the invention has been described in connection with the preferred embodiment, it is not intended to limit the invention to the particular forms set forth, but, on the contrary, it is intended to cover alternatives, modifications, and equivalents as may be included within the spirit and scope of the invention as defined by the appended claims.

I claim:

1. A golf club grip for a tubular shaft of a golf club, said shaft concentric about a first longitudinal axis, said grip comprising:

a generally tubular body portion eccentrically surrounding and extending a length along an upper section of said shaft;

a first end of said body portion proximal to said shaft;

a second capped end of said body portion opposite said first end, said body portion having a wall thickness and an outer surface having a multiplicity of planar faceted faces extending said entire length of said grip, said wall thickness beneath each of said planar faceted faces, except a flat top planar face, varying from said second capped end of said body portion to said first end of said body portion, said wall thickness beneath said top planar face and the width of said top planar face remaining constant the entire length of said grip from said second capped end to said first end, said wall thickness beneath said top planar face being less than said wall thickness beneath said other planar faceted faces.

2. The grip of claim 1 wherein said body portion further comprises an outer surface having twelve planar faceted faces extending said entire length of said grip.

3. The grip of claim 2 wherein said planar faceted faces are continuous from said first end of said body portion to said second end of said body portion, said planar faceted faces being bilaterally symmetrical about a vertical median plane of said body portion.

4. The grip of claim 1 wherein said body portion further comprises an outer surface having ten planar faceted faces extending said entire length of said grip.

5. The grip of claim 4 wherein said planar faceted faces are continuous from said first end of said body portion to said second capped end of said body portion.

6. The grip of claim 5 wherein said body portion further comprises a single elongated planar face along said left side of said body portion, said top side, said right side, and said bottom side having nine distinct planar faceted faces all of said faces continuous from said first end of said body portion to said second capped end of said body portion.

7. The grip of claim 1 wherein said body portion and said shaft are constructed as one continuous unit.

* * * * *